US006625940B2

(12) United States Patent
Sanger

(10) Patent No.: US 6,625,940 B2
(45) Date of Patent: Sep. 30, 2003

(54) CONCRETE BUILDING MODULE WITH MODULE LIFTING MEANS AND METHOD

(76) Inventor: Wallace D. Sanger, 11333 Acme Rd., West Palm Beach, FL (US) 33414

( * ) Notice: Subject to any disclaimer, the term of this patent is extended or adjusted under 35 U.S.C. 154(b) by 142 days.

(21) Appl. No.: 09/775,834

(22) Filed: Feb. 2, 2001

(65) Prior Publication Data

US 2002/0104287 A1 Aug. 8, 2002

(51) Int. Cl.[7] ..... E04H 12/34

(52) U.S. Cl. ..... 52/125.4; 52/64; 52/125.6; 52/127.2; 52/127.5; 52/745.2; 52/747.12

(58) Field of Search ..... 52/125.1–125.6, 52/126.1, 127.2, 127.5–127.7, 223.13, 223.14, 223.7, 745.2, 747.12, 64, 125.2, 125.4

(56) References Cited

U.S. PATENT DOCUMENTS

| | | | | | |
|---|---|---|---|---|---|
| 269,018 | A | * | 12/1882 | Crowell et al. | |
| 777,441 | A | * | 12/1904 | Small | |
| 3,449,874 | A | * | 6/1969 | Beaupre' | |
| RE31,131 | E | * | 1/1983 | Torbet et al. | 294/89 |
| 5,319,896 | A | * | 6/1994 | Winger | 52/23 |
| 5,355,640 | A | * | 10/1994 | Frye | 52/23 |
| 5,384,993 | A | * | 1/1995 | Phillips | 52/92.2 |
| 5,522,184 | A | * | 6/1996 | Oviedo-Reyes | 52/23 |
| 5,531,054 | A | * | 7/1996 | Ramirez | 52/741.1 |
| 5,537,786 | A | * | 7/1996 | Lozier et al. | 12/23 |
| 5,588,272 | A | * | 12/1996 | Haponski | 52/309.12 |
| 5,661,930 | A | * | 9/1997 | Porter | 52/64 |
| 5,687,512 | A | * | 11/1997 | Spoozak et al. | 52/23 |
| 6,058,672 | A | * | 5/2000 | McClellan | 52/587.1 |
| 6,161,339 | A | * | 12/2000 | Cornett, Sr. et al. | 52/23 |
| 6,176,050 | B1 | * | 1/2001 | Gower | 52/222 |

* cited by examiner

*Primary Examiner*—Carl D. Friedman
*Assistant Examiner*—Yvonne M. Horton
(74) *Attorney, Agent, or Firm*—Frank L. Kubler

(57) ABSTRACT

A concrete building module includes a concrete roof having a roof beam with a beam upper surface and a beam lower surface; a lifter mounting fitting embedded in the beam upper surface and oriented to be accessible from above the roof; an upper link connection structure embedded in the beam lower surface below the lifter mounting fitting; a concrete floor having a floor upper surface; a lower link connection structure embedded into the floor upper surface below the upper link connection structure; a linking member extending between and removably connected to the upper link connection structure and to the lower link connection structure; and at least one module concrete side wall interconnecting the module concrete roof and the module concrete floor.

18 Claims, 4 Drawing Sheets

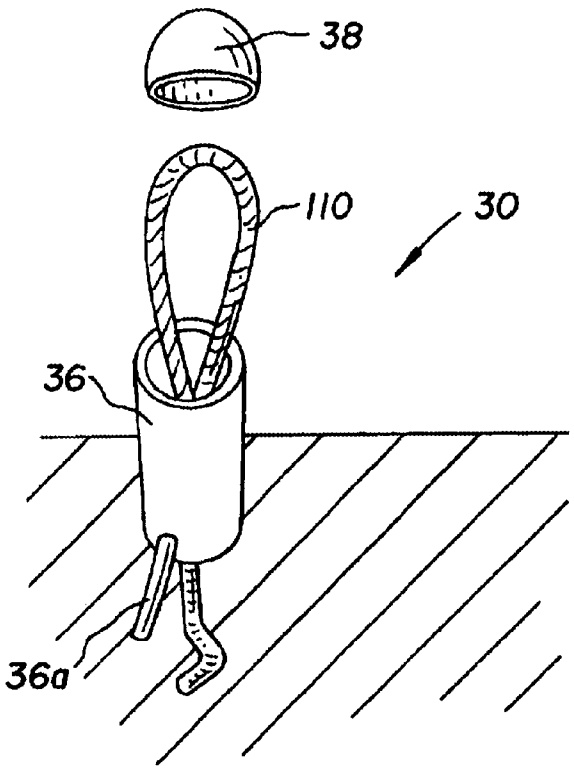
FIG. 7
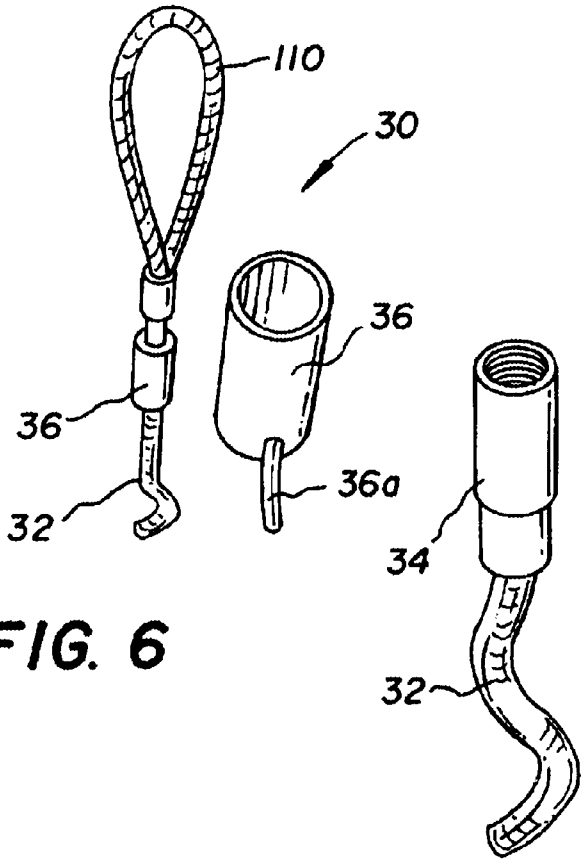
FIG. 6
FIG. 5

CONCRETE BUILDING MODULE WITH MODULE LIFTING MEANS AND METHOD

BACKGROUND OF THE INVENTION

1. Field of the Invention

The present invention relates generally to the field of prefabricated concrete building components. More specifically the present invention relates to a concrete building module with a concrete roof including a pre-tensioned concrete roof beam having lifter mounting fittings embedded in the roof beam upper surface and oriented to be accessible from above the roof, and directly below each lifter mounting fitting an upper link connection structure embedded in the roof lower surface. The module further includes a concrete floor having a lower link connection structure embedded in the concrete floor directly below each upper link connection structure, and a series of linking members, each of which is extended vertically between and removably connected to each corresponding pair of upper and lower link connection structures. These linking members preferably include chains, each linking member including a tensioning mechanism for drawing the linking member into high tension between the upper link connection structure and the lower link connection structure. Finally, the modules include first, second and third module side walls extending between the module roof and floor.

As a result of this construction, a lifter can be connected to each lifter mounting fitting and a crane hook can engage the lifters and lift the module without damage to the module, because the loading on the roof resulting from the force on the lifters is transferred and distributed through the linking members partially to the floor, thereby minimizing the loading at any given point on the module and preventing module concrete fracture and failure.

2. Description of the Prior Art

There have long been pre-fabricated building walls for subsequent assembly into concrete buildings at a construction site remote from the forming site. Lifters have been provided for embedding into the wall concrete for lifting the walls into and off of trucks. There have also been concrete building modules, but no means have been provided for safely lifting such a module without substantial risk of module fracture and failure due to possible bowing and breaking of the module roof or other top wall which is pulled laterally during lifting.

It is thus an object of the present invention to provide a concrete building module and module reinforcing means and lifting means for causing the module to be reliably sturdy and integral for lifting as a whole with a crane without significant risk of module concrete failure.

It is another object of the present invention to provide a concrete building module and module reinforcing means and lifting means which are formed of common and inexpensive materials.

It is still another object of the present invention to provide a concrete building module and module reinforcing means and lifting means which can be assembled easily by workmen of ordinary skill.

It is finally an object of the present invention to provide a concrete building module and module reinforcing means and lifting means which does not detract from the finished module and for which the reinforcing and lifting can be reinstalled readily.

SUMMARY OF THE INVENTION

The present invention accomplishes the above-stated objectives, as well as others, as may be determined by a fair reading and interpretation of the entire specification. structure and said lower link connection structure.

A concrete building module is provided, including a concrete roof having a roof beam with a beam upper surface and a beam lower surface; a lifter mounting fitting embedded in the beam upper surface and oriented to be accessible from above the roof; an upper link connection structure embedded in the beam lower surface below the lifter mounting fitting; a concrete floor having a floor upper surface; a lower link connection structure embedded into the floor upper surface below the upper link connection structure; a linking member extending between and removably connected to the upper link connection structure and to the lower link connection structure; and at least one module concrete side wall interconnecting the module concrete roof and the module concrete floor.

The concrete building module preferably additionally includes a lifter fitted into the lifter mounting fitting. The linking member preferably includes a length of chain. The linking member preferably includes a tensioning mechanism for drawing the linking member into tension between the upper link connection structure and the lower link connection structure. Each lifter mounting fitting preferably includes a segment of reinforcing bar having an internally threaded lifter receiving tube secured to one end of the reinforcing bar; where the lifter mounting fitting is embedded in the concrete roof so that the lifter receiving tube opens out of the roof upper surface.

The concrete building module preferably additionally includes a lifter recess in the roof upper surface having a recess bottom wall, where the lifter receiving tube opens out of the recess bottom wall. The concrete building module preferably still additionally includes a liner tube lining the recess side wall. The liner tube preferably protrudes above the roof upper surface, and the module preferably additionally includes a liner tube cap removably fitted over the liner tube.

Each upper and lower link connection structure preferably includes a face plate having an eye-screw passing port; an internally threaded eye-screw receiving tube affixed substantially perpendicularly to the face plate and registering with the eye-screw passing port; at least one anchoring bolt affixed to and protruding from the face plate; and an eye-screw fitted through the eye-screw passing port and screwed into the eye-screw receiving tube after the remainder of the link connection structure. The linking member preferably includes a chain and has a hook at each linking member end to engage the eye-screws of the upper link connection structure and of the lower link connection structure.

A method is provided of reinforcing a concrete building module having a concrete module roof having a roof upper surface and a roof lower surface, a concrete module floor having a floor upper surface, and at least one concrete module wall interconnecting the module roof and the module floor, including the steps of securing an upper link connection structure to the roof lower surface; securing a lower link connection structure to the floor upper surface below the upper link connection structure; securing a lifter to the module roof upper surface above the upper link connection structure; securing a linking member to the upper link connection structure and to the lower link connection structure; and placing the linking member in tension. The method preferably includes the additional step of engaging the lifter with a hook on a crane cable.

BRIEF DESCRIPTION OF THE DRAWINGS

Various other objects, advantages, and features of the invention will become apparent to those skilled in the art from the following discussion taken in conjunction with the following drawings, in which:

FIG. 5 is a perspective view of one of the combined reinforcing bars and lifter receiving tube.

FIG. 6 is a perspective view of the complete lifter mounting fitting and lifter inserted into the lifter mounting fitting, and a lifter receiving tube beside the lifter mounting fitting.

FIG. 7 is a perspective cross-sectional side view of the assembled lifter, lifter mounting fitting and lifter receiving tube, and a tube cap above the lifter mounting tube.

DETAILED DESCRIPTION OF THE PREFERRED EMBODIMENTS

Figure 1:
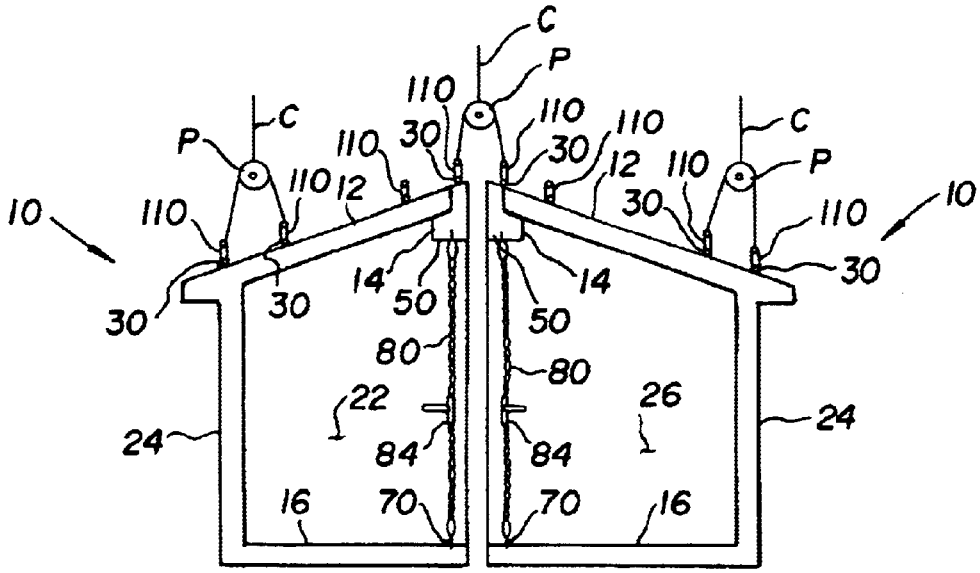
FIG. 1 is a cross-sectional side view of two of the inventive building modules placed side by side to form a complete building, the modules being lifted by crane cables C connected load equalizing pulleys P hooked onto the module lifters.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
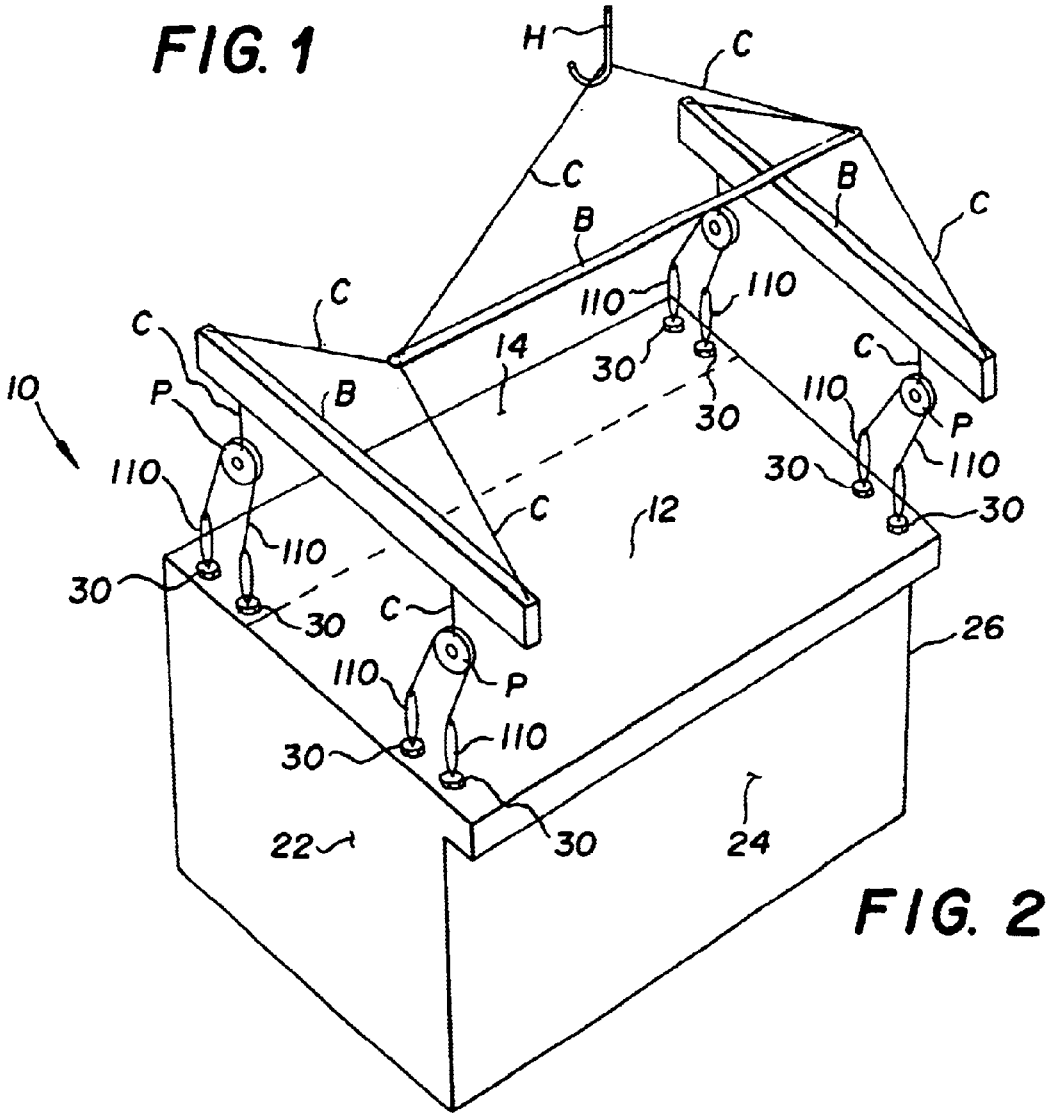
FIG. 2 is a perspective view of one of the inventive modules being lifted by its lifters by a preferred crane cable assembly made up of load equalizing pulleys P and lifting beams B joined by crane cables C.
Figure 4:
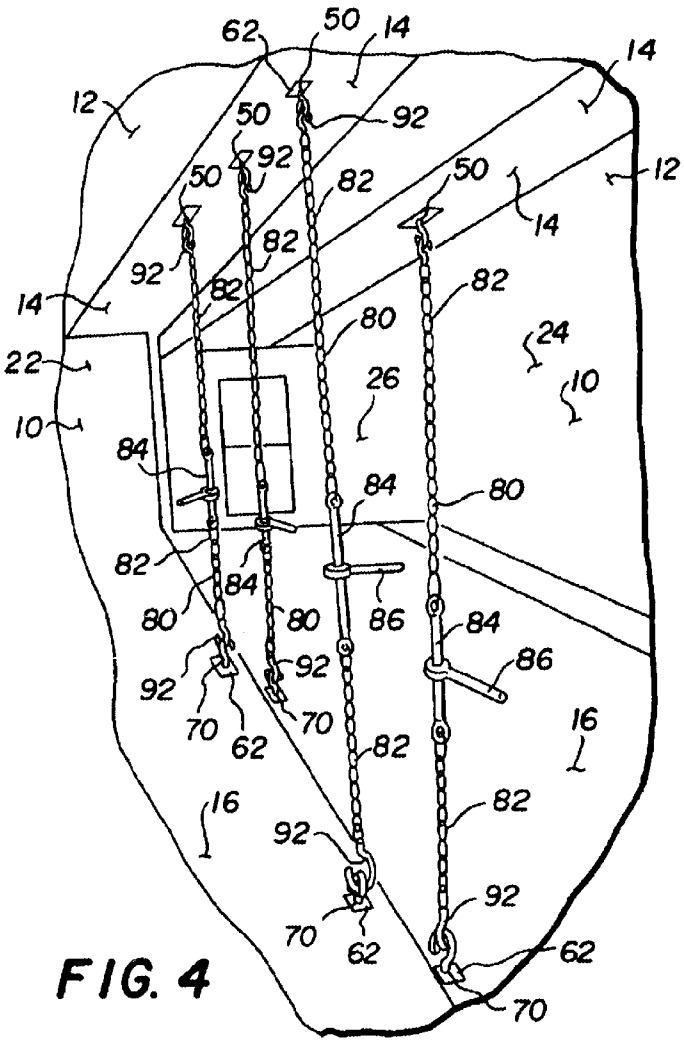
FIG. 4 is a view as in FIG. 3 showing a series of the tensioned linking members secured to the roof beam and floor.
Figure 3:
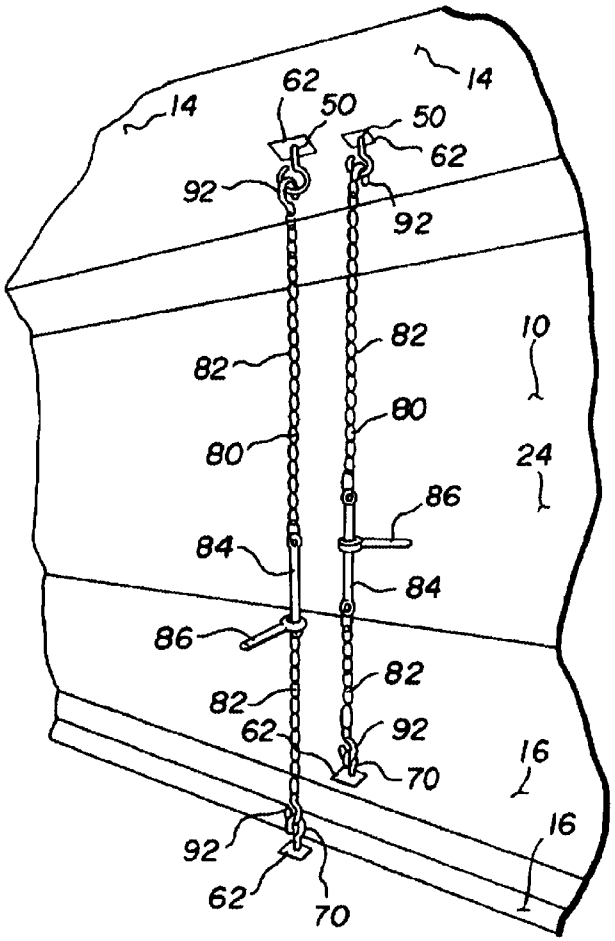
FIG. 3 is a broken away interior view of two of the modules side by side, one of which is slightly lifted relative to the other, showing the tensioned linking members secured to the roof beam and floor.
Figure 9:
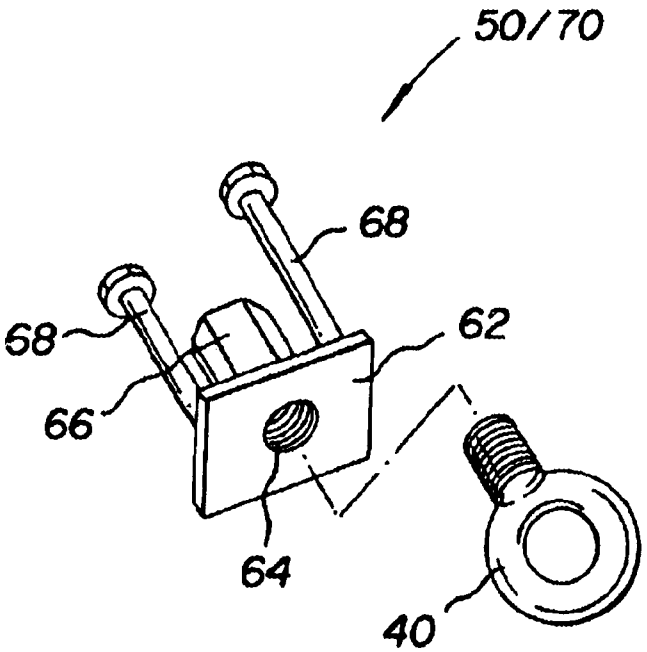
FIG. 9 is a bottom perspective view of an upper or lower link connection structure.
Figure 8:
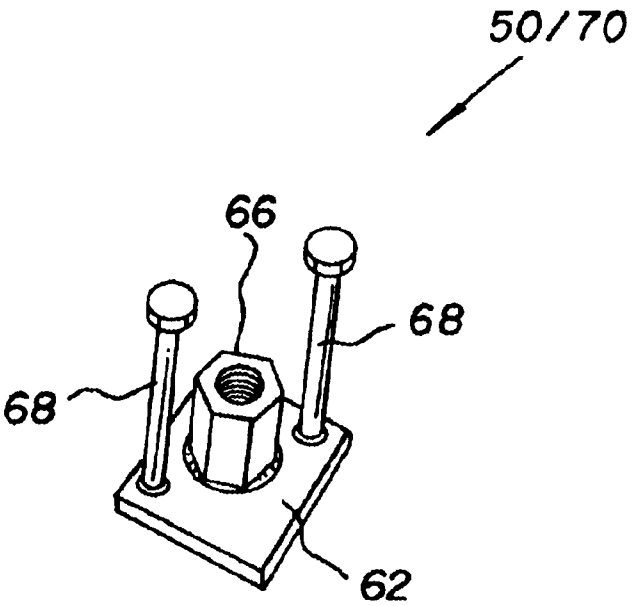
FIG. 8 is a top perspective view of an upper or lower link connection structure.

Referring to FIGS. 1–9, a concrete building module or concrete building is disclosed, hereinafter collectively referred to as a building module 10, with a concrete roof 12 including a pre-tensioned concrete roof beam 14 having lifter mounting fittings 30 embedded in the roof beam 14 upper surface and oriented to be accessible from above the roof 12, and directly below each lifter mounting fitting 30 an upper link connection structure 50 is embedded in the roof 12 lower surface. The module further includes a concrete floor 16 having a lower link connection structure 70 embedded in the concrete floor 16 directly below each upper link connection structure 50, and a series of linking members 80, each of which is extended vertically between and removably connected to each corresponding pair of upper and lower link connection structures 50 and 70, respectively. These linking members 80 preferably includes chains 82, and alternatively include cables (not shown), each linking member 80 including a tensioning mechanism 84 for drawing the linking member 80 into tension between the upper link connection structure 50 and the lower link connection structure 70. Finally, the modules 10 include first, second and third module side walls 22, 24 and 26 extending between the roof 12 and floor 16.

As a result of this construction, a lifter 110 can be connected to each lifter mounting fitting 30 and a crane hook H can engage the lifters and lift the module 10 without damage to the module 10, because the loading on the roof 12 resulting from the force on the lifters 110 is transferred and distributed through the linking members 80 partially to the floor 16, thereby minimizing the loading at any given point on the module 10 and preventing module 10 concrete fracture and failure. Additional lifter mounting fittings 30 are provided along the upper ends of the module side walls 22 and 26, and the side walls 22 and 26 themselves provide structural connection between the roof 12 and floor 16 so that no special interconnection means is needed at these locations.

Each lifter mounting fitting 30 preferably includes segment of heavy reinforcing bar 32 which is preferably curved or bent for enhanced anchoring ability, the reinforcing bar 32 having an internally threaded lifter receiving tube 34 press fitted around one end. See FIG. 5. The lifter mounting fitting 30 is embedded in the beam 14 or roof 12 concrete during forming so that the lifter receiving tube 34 opens out of the surface of the beam 14 or roof 12. It is preferred that the lifter receiving tube 34 open out of the bottom of a recess in the beam or roof, the sides of the recess being formed and defined by a polyvinyl chloride or PVC liner tube segment 36. The liner tube segment 36 preferably protrudes above the surface of the beam 14 or roof 12 so that a PVC cap 38 can be fitted over the liner tube segment 36 when the lifter mounting fitting 32 is not in use. See FIGS. 6 and 7. The liner tube segments 36 each preferably have a metal or plastic anchor tab 36*a* fastened to its embedded end and protruding outwardly into the beam 14 or roof 12 concrete.

Each upper and lower link connection structure 50 and 70, respectively, preferably includes a metal face plate 62 having a central eye-screw passing port 64 and an internally threaded eye-screw receiving tube 66 welded substantially perpendicularly to the face plate 62 and registering with the eye-screw passing port 66. Several, and preferably four anchoring bolts 68 are welded to the face plate 66 along its periphery, substantially evenly distributed around the loop screw receiving tube 66, to anchor the link connection structure 50 or 70 in the roof or floor concrete, respectively. An eye-screw 40 is screwed into each eye-screw receiving tube 66 after the remainder of the link connection structure 50 or 70 is formed into the beam 14, roof 12 or floor 16.

FIGS. 3, 4, 8 and 9.

The linking members 80 are preferably chains 82 having a hook 92 at each end to engage the eye-screws 40 of the upper and lower link connection structures 50 and 70. A telescoping tube and bolt tensioning mechanism 84 of known construction is provided within the chain, preferably at the middle of the chain, and has a tensioning lever 86 to rotate around the vertical chain to draw it into high tension. This tensioning is necessary so that the beam 14 and roof 12 do not bow upwardly before loading is transferred to the module floor 16.

It is contemplated that in some instances a roof pre-tensioned beam 14 may not be provided as part of the module concrete roof 12, and that the upper link connection structure 50 and the lifter mounting fitting 30 may be embedded in the module concrete roof 12.

Method

In practicing the invention, the following method may be used. Securing an upper link connection structure 50 to the lower surface of a module roof; securing a lower link connection structure 70 to the upper surface of a module floor below said upper link connection structure 50, securing a lifter to the module roof above the upper link connection structure 50; securing a linking member 80 to the upper link connection structure 50 and to the lower link connection structure 70; placing the linking member 80 in tension; engaging the lifter with a crane cable and lifting the module.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A concrete building module, comprising:

a concrete module roof having a roof upper surface and a roof lower surface;

a lifter mounting fitting embedded in said roof upper surface and oriented to be accessible from above said module roof;

an upper link connection structure embedded in the roof lower surface below said lifter mounting fitting;

a concrete module floor having a floor upper surface;

a lower link connection structure embedded into said floor upper surface below said upper link connection structure;

a linking member extending between and removably connected to said upper link connection structure and to said lower link connection structure;

and at least one concrete module side wall interconnecting said concrete module roof and said concrete module floor.

2. The concrete building module of claim 1, additionally comprising a lifter fitted into said lifter mounting fitting.

3. The concrete building module of claim 1, wherein said concrete module roof comprises a pre-tensioned concrete roof beam.

4. The concrete building module of claim 1, wherein said linking member comprises a length of chain.

5. The concrete building module of claim 4, wherein said linking member comprises a tensioning mechanism for drawing said linking member into tension between said upper link connection structure and said lower link connection structure.

6. The concrete building module of claim 1, wherein each said lifter mounting fitting comprises a segment of reinforcing bar having an internally threaded lifter receiving tube secured to one end of said reinforcing bar; p1 wherein said lifter mounting fitting is embedded in said concrete module roof such that said lifter receiving tube opens out of said roof upper surface.

7. The concrete building module of claim 6, additionally comprising a lifter recess in said roof upper surface having a recess bottom wall, wherein said lifter receiving tube opens out of said recess bottom wall.

8. The concrete building module of claim 7, additionally comprising a liner tube lining the recess side wall.

9. The concrete building module of claim 8, wherein said liner tube protrudes above said roof upper surface, additionally comprising a liner tube cap removably fitted over said liner tube.

10. The concrete building module of claim 1, wherein each said upper and lower link connection structure comprises:

a face plate having an eye-screw passing port;

an internally threaded eye-screw receiving tube affixed substantially perpendicularly to said face plate and registering with said eye-screw passing port;

at least one anchoring bolt affixed to and protruding from said face plate;

and an eye-screw fitted through said eye-screw passing port and screwed into said eye-screw receiving tube after the remainder of said link connection structure.

11. The concrete building module of claim 10, wherein said linking member comprises a chain and has a hook at each linking member end to engage said eye-screws of said upper link connection structure and of said lower link connection structure.

12. A method of reinforcing a concrete building module having a concrete module roof having a roof upper surface and a roof lower surface, a concrete module floor having a floor upper surface, and at least one concrete module side wall interconnecting said module roof and said module floor, comprising the steps of:

securing an upper link connection structure to said roof lower surface, such that said upper link connection structure is spaced laterally from said module side wall;

securing a lower link connection structure to said floor upper surface spaced laterally from said module side wall and below said upper link connection structure;

securing a lifter to said module roof upper surface above said upper link connection structure;

and securing a linking member to said upper link connection structure and to said lower link connection structure, such that said linking member is spaced laterally from and is separate from said module side wall and such that said linking member provides a structural connection between said module roof and said module floor which is spaced laterally from and is separate from said module side wall.

13. The method of claim 12, comprising the additional steps of placing said linking member in tension and engaging said lifter with a hook on a crane cable.

14. A concrete building module, comprising:

a concrete module roof having a roof beam with a beam upper surface and a beam lower surface;

a lifter mounting fitting embedded in said beam upper surface and oriented to be accessible from above said module roof;

an upper link connection structure embedded in the beam lower surface below said lifter mounting fitting;

a concrete module floor having a floor upper surface;

a lower link connection structure embedded into said floor upper surface below said upper link connection structure;

a linking member extending between and removably connected to said upper link connection structure and to said lower link connection structure;

and at least one concrete module side wall interconnecting said concrete module roof and said concrete module floor.

15. The concrete building module of claim 14, additionally comprising a lifter fitted into said lifter mounting fitting.

16. The concrete building module of claim 14, wherein said linking member comprises a length of chain.

17. The concrete building module of claim 14, wherein said linking member comprises a tensioning mechanism for drawing said linking member into tension between said upper link connection structure and said lower link connection structure.

18. A concrete building module, comprising:

a concrete module roof having a roof upper surface and a roof lower surface;

a lifter mounting fitting embedded in said roof upper surface and oriented to be accessible from above said module roof;

an upper link connection structure embedded in the roof lower surface below said lifter mounting fitting;

a concrete module floor having a floor upper surface;

a lower link connection structure embedded into said floor upper surface below said upper link connection structure;

a linking member extending between and removably connected to said upper link connection structure and to said lower link connection structure;

and at least one concrete module side wall interconnecting said concrete module roof and said concrete module floor, said concrete module side wall being spaced concrete module floor, said separate from said linking member.

* * * * *